US005694780A

United States Patent [19]

Alsenz

[11] Patent Number: 5,694,780

[45] Date of Patent: Dec. 9, 1997

[54] CONDENSED LIQUID PUMP FOR COMPRESSOR BODY COOLING

[76] Inventor: Richard H. Alsenz, 1545 Industrial Dr., Missouri City, Tex. 77489

[21] Appl. No.: 530,460

[22] Filed: Dec. 1, 1995

[51] Int. Cl.[6] ..... F25B 31/00; F25B 41/00

[52] U.S. Cl. ..... 62/117; 62/129; 62/505; 62/DIG. 2; 62/513; 417/228

[58] Field of Search ..... 62/DIG. 2, 505, 62/129, 117, 513; 417/228

[56] References Cited

U.S. PATENT DOCUMENTS

| | | | |
|---|---|---|---|
| 2,510,887 | 6/1950 | Hawson | 62/505 X |
| 3,172,270 | 3/1965 | Mirante | 62/DIG. 2 |
| 4,599,873 | 7/1986 | Hyde | 62/498 |
| 5,067,326 | 11/1991 | Alsenz | 62/193 |
| 5,115,644 | 5/1992 | Alsenz | 62/181 |
| 5,150,580 | 9/1992 | Hyde | 62/86 |
| 5,396,780 | 3/1995 | Bendtsen | 62/212 |

FOREIGN PATENT DOCUMENTS

| | | | |
|---|---|---|---|
| 0124354 | 10/1978 | Japan | 62/505 |
| 0901760 | 2/1982 | U.S.S.R. | 62/505 |

OTHER PUBLICATIONS

Dossat, Roy J., *Principles of Refrigeration*, 3rd Ed., Prentice Hall Career & Technology, Englewood Cliffs, NJ (1991), pp. 1–552.

*Primary Examiner*—William E. Wayner

*Attorney, Agent, or Firm*—Conley, Rose & Tayon, PC; David A. Rose

[57] ABSTRACT

A refrigeration system which has in a closed loop a compressor body, with a cooling jacket, for compressing a refrigerant, a condenser for condensing the compressed refrigerant to a liquid refrigerant, and a condensed liquid pump for compressor body cooling. The compressor body is thermally coupled to a cooling jacket, through which a cooling liquid flows. The condensed liquid pump pumps condensed liquid refrigerant from the condenser through the cooling jacket, cooling the compressor body, and then to the compressor cylinder head exhaust manifold, where the liquid refrigerant mixes with and cools the hot compressor discharge gas.

35 Claims, 5 Drawing Sheets

CONDENSED LIQUID PUMP FOR COMPRESSOR BODY COOLING

FIELD OF THE INVENTION

The present invention relates generally to a refrigeration system. More particularly, this invention relates to an apparatus and method for improving the overall efficiency and reliability and reducing the operating and maintenance costs, of refrigeration system compressors by using condensed refrigerant to cool the refrigeration compressor, lubricating oil, and compressor body.

BACKGROUND OF THE INVENTION

Refrigeration system compressor failures are known to be associated with high compressor body temperatures. Some common attempts to cool the compressor bodies include fans circulating air over the bodies, and injecting liquid condensate into the suction or low pressure side of the refrigeration system. Both methods result in increased energy usage and have various associated problems. Air circulation is not very effective due to the amount of heat that must be removed. njecting liquid into the suction side of the refrigeration system has the problems associated with controlling the amount of liquid injected; too much liquid and the compressor will fail due to damage to the valving system, too little refrigerant injected will result in high temperatures which will result in bearing failure. The current invention solves the problem by circulating liquid condensate through a cooling jacket surrounding the compressor and body then into the head of the compressor on the discharge or high pressure side of the compressor.

SUMMARY OF THE INVENTION

The present invention provides for a refrigeration system which has in a closed loop, a compressor for compressing a refrigerant, a condenser for condensing the compressed refrigerant to a liquid refrigerant, and a condensed liquid pump for compressor body cooling. The compressor body is thermally coupled to a cooling jacket, which may be a cavity or cavities within the body for passing a cooling liquid through the cooling jacket and around the compressor body. The inlet of the condensed liquid pump is coupled to a source of condensed liquid refrigerant, which may be the condenser, and the outlet of the condensed liquid pump is coupled to the cooling jacket inlet. A cooling jacket outlet, coupled to the discharge side of the compressor cylinder head(s), is provided to discharge refrigerant from the cooling jacket into the hot compressor discharge gas in the compressor cylinder head(s).

In operation, the condensed liquid pump draws liquid from the liquid refrigerant source and pumps it into and through the cooling jacket which cools the compressor body. The refrigerant then flows out of the cooling jacket outlet into the compressor cylinder head, cooling the cylinder head and the hot compressor discharge gas. The condensed liquid pump is driven by drive means including, for example, a fixed speed electric motor, a variable speed electric motor, or the compressor drive means.

In refrigeration systems including a lubrication oil pump for providing lubrication oil to the compressor, the condensed liquid pump may be driven by the same motor or other means used to drive the lubricating oil pump. Both the lubricating oil pump and condensed liquid pump may be driven by the compressor crankshaft or the compressor drive means. A heat exchanger is provided for cooling the lubricating oil by heat transfer from the lubricating oil to the condensed liquid coolant.

Examples of the more important features of the invention have been summarized rather broadly in order that the detailed description thereof that follows may be better understood, and in order that the contributions to the art may be better appreciated. There are, of course, additional features of the invention that will be described hereinafter and which will form the subject of the appended claims. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a detailed description of a preferred embodiment of the invention, reference will now be made to the accompanying drawings.

DESCRIPTION OF THE PREFERRED EMBODIMENTS

For purposes of illustration and not by way of limitation, the present invention shall be described with respect to a refrigeration system and method wherein improved compressor maintenance, reliability, and efficiency are obtained by compressing a refrigerant to a high pressure and temperature, cooling the compressor body by circulating condensed or subcooled liquid refrigerant through a compressor body cooling jacket, and injecting liquid refrigerant into the cylinder heads.

Figure 1:
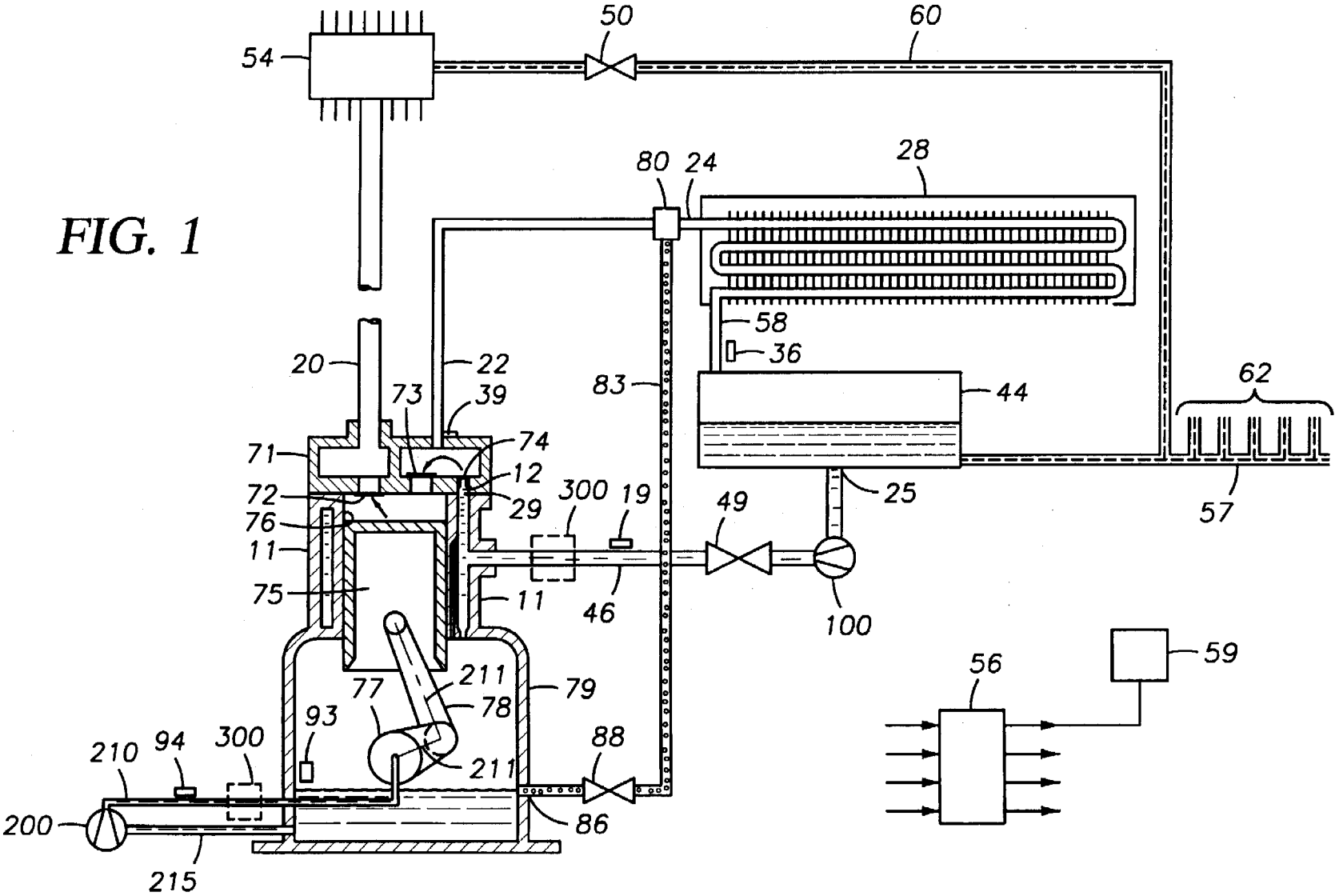
FIG. 1 depicts a refrigeration system embodying the invention and includes a simplified cross-section view of a compressor showing details of the cylinder head cooling apparatus of the present invention.

Referring now to FIG. 1, an embodiment of the refrigeration system of the present invention is shown. The system includes at least one compressor 14, with a cooling jacket 11, at least one condenser 28, at least one evaporator 54, with an expansion device 50, a reservoir 44 for holding liquid and vapor refrigerant, a compressor body cooling system, and a control circuit 56 containing a microprocessor to control various functions of the refrigeration system including the compressor body cooling system. The compressor body cooling system includes at least one coolant temperature sensor 29 near the outlet 12 of the compressor body cooling jacket 11 to provide a signal representative of the operating temperature of the refrigerant in the cooling jacket, a condensed liquid recycle line 46 coupled at one end to a condensed liquid take-off point 25 of receiver 44 and coupled at its other end to the cooling jacket 11 to recycle refrigerant liquid, and a condensed liquid pump 100 disposed in recycle line 46 for pumping liquid from the receiver 44 to the cooling jacket 11. Cooling jacket 11 may comprise the annular space or cooling passages created by enclosing the compressor body in a cooling jacket. The refrigeration system may also contain a control valve 49 disposed in the liquid recycle line 46 to vary the flow rate of recycled cooling liquid for compressor body cooling. A cylinder head temperature sensor 39 may optionally be disposed near the outlet line discharging coolant from the compressor cylinder heads to provide a signal representative of the cylinder head operating temperature. A coolant flowmeter 19, or other flow measuring and/or indicating device as is known in the art, may be disposed near recycle line 46 to provide a signal representative of the coolant flow rate. Coolant temperature sensor 29, cylinder head temperature sensor 39, and coolant flowmeter may be electrically connected to microcontroller 56.

The microcontroller circuit 56 contains a microprocessor and other circuitry which enables it to access information from various sensors used in the refrigerator system, to process these signals, and to control a variety of functions of the refrigeration system.

Figure 2:
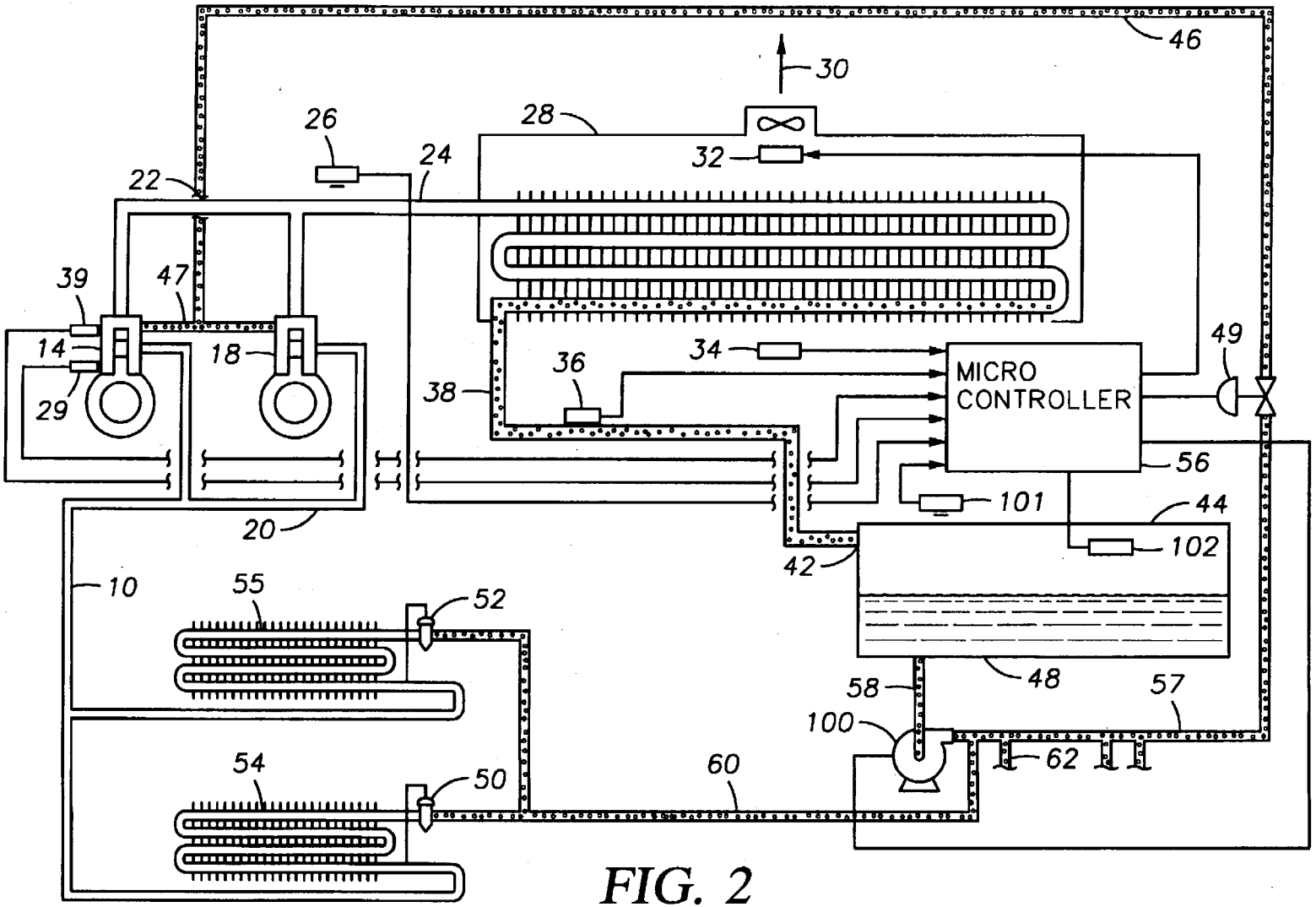
FIG. 2 depicts another refrigeration system embodying the invention.

Referring now to FIG. 2, the embodiment of the refrigeration system of the present invention depicted therein is a closed loop, commonly connected, multiple-stage refrigeration system. A vapor refrigerant at a low pressure is passed through a refrigerant line 10 into manifold 20 and into parallel compressors 14 and 18. The compressors 14 and 18 compress the refrigerant to a high pressure gaseous state and discharge it through refrigerant lines 22 and 24 which communicate with a condenser 28. The condensed refrigerant leaves the condenser 28 through liquid line 38 as a liquid, and is discharged into a main fluid reservoir 44 through a main line 58. The liquid from the reservoir 44 flows through line 58 into a liquid manifold system 57, where it enters a liquid line that is connected to expansion valves 50 and 52. Each expansion valve 50 and 52 is connected to separate parallel evaporators 54 and 55 respectively. These evaporators form a refrigeration system wherein the expansion valves 50 and 52 meter the liquid refrigerant into evaporators 54 and 55 respectively. Similarly, other evaporator systems (not shown) may be connected to the liquid manifold system 57 via lines 62 and the like. When the liquid refrigerant is metered through the expansion valves 50 or 52, it evaporates into a gaseous state within its respective evaporator at a low pressure and a low temperature. The low pressure vapor refrigerant is passed to the compressors 14 and 18 through the suction line 10 and suction manifold 20. Compressors 14 and 18 compress the refrigerant vapor and discharge the compressed vapor into discharge line 22. The compressed vapor then passes through condenser inlet line 24 to condenser 28. Condenser 28 causes the refrigerant vapor to be cooled and condensed into a liquid phase by cooling the condenser coils with air at ambient temperature. The liquid refrigerant may also be subcooled in condenser 28. In any case, liquid refrigerant is discharged from condenser via liquid line 38, which completes a refrigeration cycle that is continuously repeated during operation.

Condensed liquid pump 100 increases the pressure in lines 46 and 60, but may also be used to increase the pressure in liquid line 60 alone, in embodiments of the present invention where the compressor body is not cooled.

Referring back to FIG. 1, there is shown in greatly simplified cross section a reciprocating compressor exemplary of a type which may be used with the present invention. While the invention is described with respect to reciprocating compressor for simplicity, it is understood that one experienced in the art may easily apply the invention to all sorts of compressors, such as reciprocating, rotary, rotary vane, screw, scroll, and centrifugal compressors, as well as hermetically sealed motor-compressor units. It is intended that the present invention apply to all sorts of compressors. Compressor 14 comprises a compressor body 79, containing one or more cylinder bores 76. Piston 75 reciprocates within cylinder bore 76, by the rotation of crankshaft 77 and connecting rod 78. Compressor cylinder head 71 is disposed at one end of compressor body 79, perpendicular to the direction of travel of piston 75. Cylinder head 71 contains passages connected to and communicating with refrigerant suction manifold 20 and refrigerant outlet line 22, and valves controlling the flow of refrigerant being compressed, such as intake valve 72 and exhaust valve 73. Cylinder head 71 also includes cooling jacket outlet 12, through which cooling liquid is passed from cooling jacket 11 into exhaust manifold 74 and mixed with hot compressed refrigerant vapor discharged from the cylinder through exhaust valve 73.

An oil separator 80 is preferably disposed in refrigerant outlet line 22 to remove lubricating oil carried over into refrigerant outlet line 22 with the compressed discharge refrigerant. A lubricating oil return line 83 is coupled to the oil outlet of oil separator 80 and to oil injection point 86, disposed in the compressor body 79. An oil level sensor 93 is disposed within compressor body 79 to provide a signal representative of the oil level within compressor body 79. Control valve 88 and level sensor 93, are preferably electrically coupled to microcontroller circuit 56 for control of the lubricating oil level within compressor body 79, as is further described in copending application Ser. No. 08/467,604, filed Jun. 6, 1995, incorporated herein by reference in its entirety.

A lubricating oil suction line 215 is preferably coupled at one end to the compressor body 79 at a point below the level of lubricating oil in body 79. Lubricating oil suction line 215 is coupled at its other end to a lubricating oil circulating pump 200, to supply lubricating oil to pump 200. An outlet of lubricating oil circulating pump 200 is coupled to one end of lubricating oil supply line 210. Oil supply line 210 is coupled at its other end to oil passages 211 for providing lubricating oil to bearings in crankshaft 77 and connecting rod 78. Oil passages 211 may be holes drilled in crankshaft 77 and connecting rod 78 as is known in the art.

In another embodiment of the invention, the coolant discharged from condensed liquid pump 100 into liquid recycle line 46 passes in heat exchange relationship with the lubricating oil circulated by lubricating oil circulating pump 200 through oil supply line 210. In this embodiment, heat exchanger 300 transfers heat from the lubricating oil in line 210 to the liquid coolant in liquid recycle line 46. The lubricating oil and liquid coolant in heat exchanger 300 may be in co-current, counter-current, or cross-current heat exchange relationship as is known in the heat transfer art.

The flow of compressor body coolant is preferably effected by a pressurization member such as condensed liquid pump 100. The coolant flow rate may require no control means but may optionally be controlled by microcontroller circuit 56. In any event the coolant flow rate may be measured by coolant flowmeter 19 or similar flow measuring means, such as pulse modulated solenoid supply, as described in copending application Ser. No. 08/467,604, filed Jun. 6, 1995, and incorporated herein by reference in its entirety. Condensed liquid pump 100 may be a variable speed pump, as is known in the art. A control valve 49 may also be used in recycle line 46 to vary the flow of cooling liquid, in which case the position of the control valve may be controlled by microcontroller 56, and condensed liquid pump 100 may be a constant speed pump. Microcontroller 56 varies the position of control valve 49 to control the flow of coolant in response to the coolant temperature sensor 29 to maintain a predetermined coolant operating temperature, or to maintain a coolant temperature just above the condensing temperature. In the latter case, microcontroller 56 controls the position of control valve 49 to maintain the temperature of the coolant a few degrees above that of the liquid line, sensed by temperature sensor 36. When the difference between the coolant temperature and the liquid line temperature exceeds a predetermined amount, microcontroller 56 increases the flow through control valve 49. Similarly, when the difference between the coolant temperature and the liquid line temperature is less than a predetermined amount, microcontroller 56 decreases the flow through control valve 49. Coolant flow may be similarly controlled to maintain a predetermined cylinder head operating temperature using temperature sensor 39.

In the case of multiple compressors (FIG. 2), separate control valves (not shown) may be placed in each of the cooling liquid injection lines 47 to individually control the flow of coolant to each compressor body individually, as described with respect to a system using a single compressor 14 in FIG. 1.

The present invention provides a condensed liquid pump 100 in the liquid line 58 disposed between the reservoir 44 and the coolant recycle line 46. In the embodiment illustrated in FIG. 1, the liquid pump 100, when in operation, recycles refrigerant liquid from the reservoir 44, through control valve 49, via recycle line 46 and heat exchanger 300, as coolant for injection into the compressor body cooling jacket 11. The coolant injected into cooling jacket 11 cools the walls surrounding cylinder bore 76 of the compressor body 79 and reduces the cylinder operating temperature.

In the multiple compressor embodiment illustrated in FIG. 2, condensed liquid pump 100 draws refrigerant from reservoir 44 through line 58. Liquid refrigerant is then supplied to manifold system 57 which includes take-offs for line 60 feeding evaporators 54 and 55, as well as coolant recycle line 46. Either arrangement of condensed liquid pump 100 and coolant line 46 may be used for both single compressor and multiple compressor systems. For example, condensed liquid pump 100 may be disposed to supply refrigerant to evaporator 54 as well as cooling jacket 11 in a single compressor system, and condensed liquid pump 100 may be disposed to supply only cooling jacket 11 in a multiple compressor system.

In all of the above embodiments, the temperature of cylinder bore 76, compressor body 79, and parts disposed therein is reduced due to heat removal by the coolant passing through cooling jacket(s) 11. The temperature of the refrigerant vapor compressed within cylinder bore 76 is consequently reduced.

As best illustrated by reference to FIG. 1, the coolant then passes from cooling jacket 11 through outlet 12 into exhaust manifold 74, which is disposed within cylinder head 71. Relatively hot refrigerant vapor, compressed by piston 75, leaves the compressor cylinder 76 through exhaust valve 73 and enters exhaust manifold 74. In exhaust manifold 74, the hot compressed refrigerant vapor leaving the cylinder 76 mixes with the coolant leaving cooling jacket 11 through outlet 12. The mixture of these two fluids has a temperature which is relatively lower than the temperature of the compressed vapor passing through exhaust valve 73. The temperature of the surfaces of exhaust manifold 74 is therefore reduced by the injection of the coolant. The temperature of cylinder head 71 and other parts disposed therein is in turn reduced by the conduction of heat through the walls of cylinder head 71.

The cooling of the compressor cylinder 76 and body 79 will reduce the temperature of the discharge gas compressed by piston 75 into the exhaust manifold 74 of cylinder head 71. Compressor body cooling and the mixing of the coolant with the hot compressed discharge gas, as described above, will further reduce the temperature of the discharge gas. By reducing the discharge gas temperature, the extent to which the refrigerant entering the condenser is superheated above its condensing temperature is decreased. Decreasing the level of superheat in the vapor entering the condenser 28 reduces the condenser heat transfer surface used to desuperheat the vapor, and therefore increases the condenser heat transfer surfaces available for condensing and subcooling service. By thus increasing the subcooling taking place in the condenser 28 the refrigeration system efficiency and refrigerating effect are increased. In another embodiment, the present invention is also applicable in combination with enhanced subcooling of the refrigerant, such as is described in U.S. Pat. No. 5,115,664, which is incorporated herein by reference.

In another embodiment, only a portion of the coolant flowing through cooling jacket 11 is discharged through cooling jacket outlet 12 into exhaust manifold 74. The coolant is then discharged from cooling jacket 11 into line 24 for desuperheating the hot compressor discharge gas in accordance with the apparatus and method described in copending application Ser. No. 08/430,637, filed Apr. 28, 1995, incorporated herein by reference in its entirety.

Figure 3:
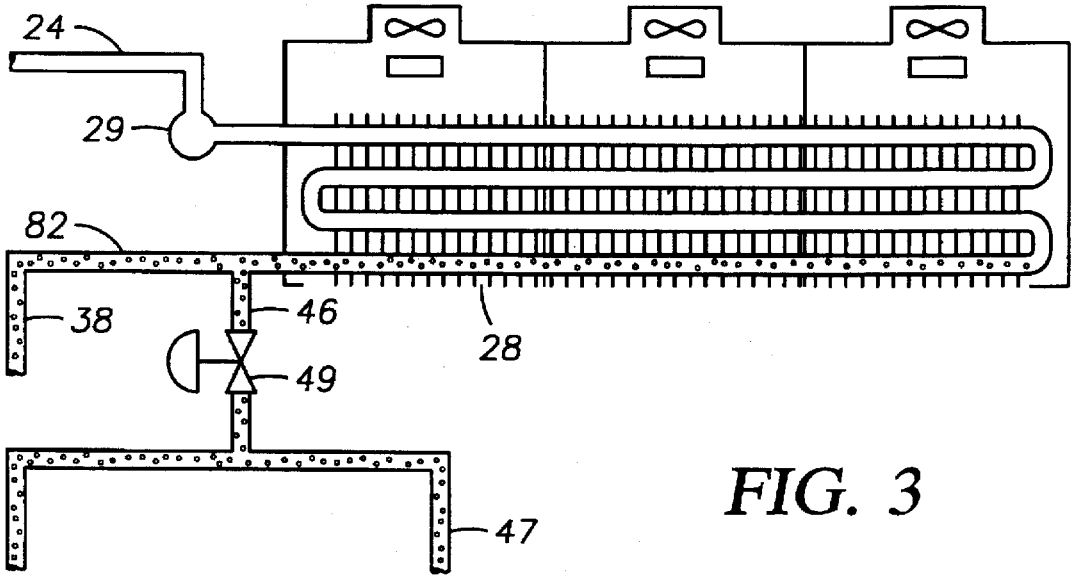
FIG. 3 depicts an embodiment of the invention including an alternate take-off point for condensed liquid refrigerant.
Figure 4:
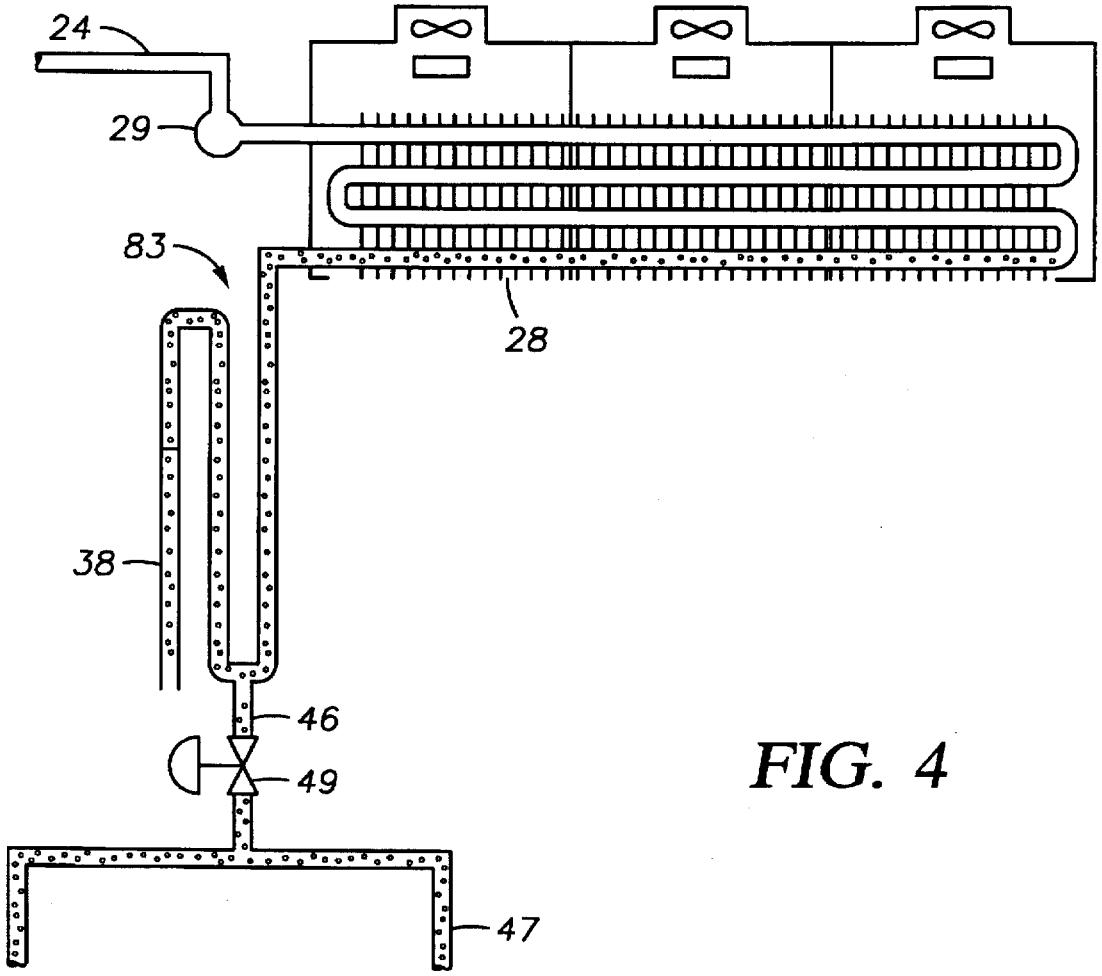
FIG. 4 depicts an embodiment of the invention including another alternate take-off point for condensed liquid refrigerant.

FIGS. 3 and 4 show the take-off of recycle liquid, as coolant for cooling the compressor body and cylinder heads, from the liquid line 38 between condenser 28 and reservoir 44, rather than from reservoir 44 itself. The liquid leaving the condenser may be maintained at a constant level by an inverted trap 82 (FIG. 3) or trap leg 83 (FIG. 4), if the condenser is at a higher level than the compressor. This eliminates the need for the condensed liquid pump 100 shown in FIG. 2, and allows the liquid to be subcooled before leaving the condenser 28, as is further described in copending application Ser. No. 08/480,773, filed Jun. 7, 1995, incorporated herein by reference in its entirety.

The embodiments of FIGS. 3 and 4 also provide a column of liquid refrigerant of sufficient height to overcome the pressure drop through condenser 28. This ensures that liquid refrigerant will flow, due to the weight of the liquid from condenser 28, to the compressor body 79. A control valve such as valve 49 or a restriction (not shown) may be placed in line 46 (or in lines 47 where two or more compressors are used) to assist in forming and controlling a liquid column in trap 82 or trap leg 83.

Figure 5:
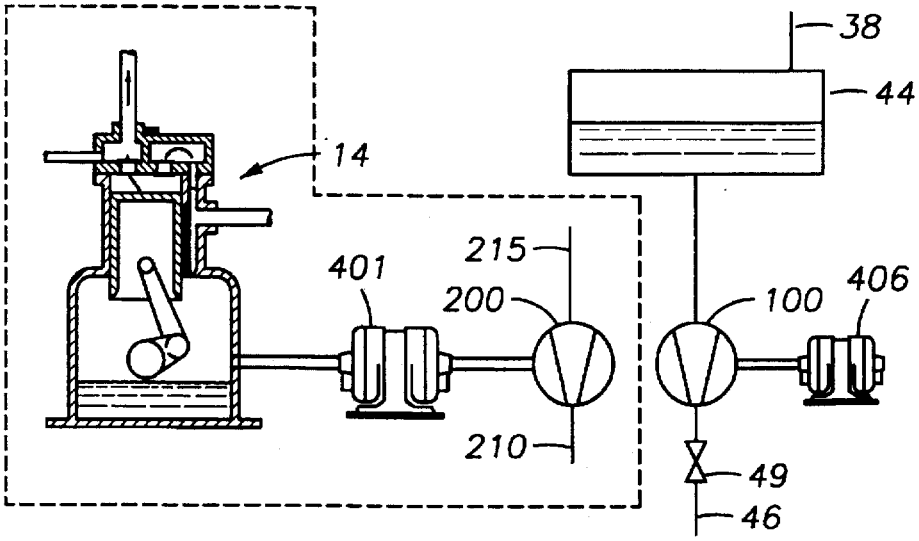
FIG. 5 depicts an exemplary means for driving the pumps and compressors of the present invention.
Figure 6:
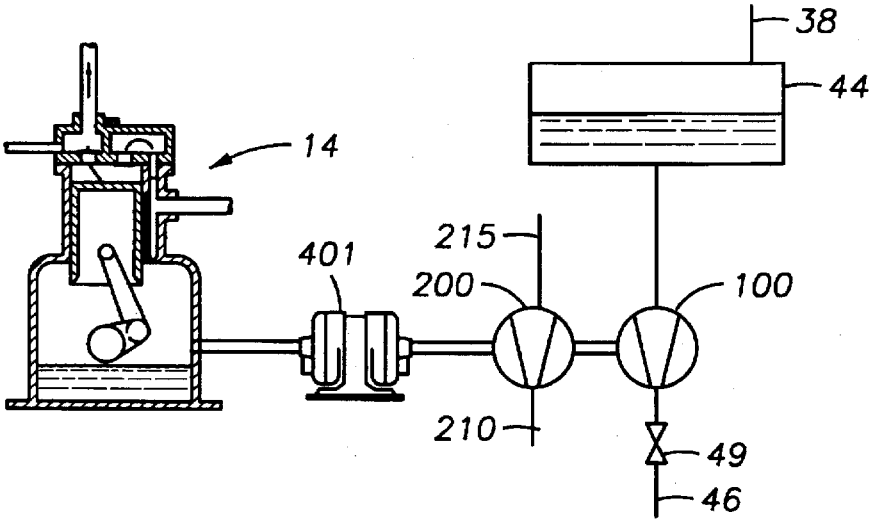
FIG. 6 depicts another exemplary means for driving the pumps and compressors of the present invention.
Figure 7:
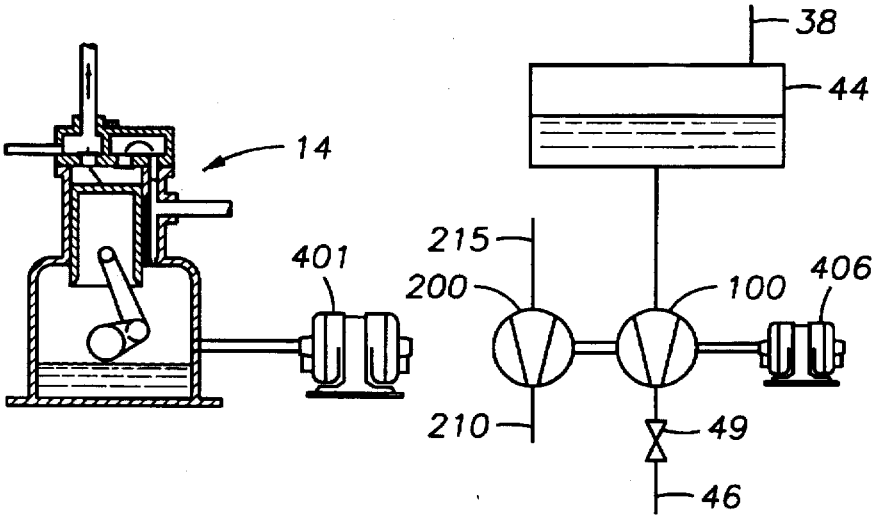
FIG. 7 depicts another exemplary means for driving the pumps and compressors of the present invention.

Referring now to FIGS. 5, 6, and 7, means for driving condensed liquid pump 100 and/or lubricating oil circulating pump 200 are described. FIG. 5 illustrates an embodiment of the invention in which compressor drive motor 401 for driving a compressor such as compressor 14, is mechanically coupled to the compressor and is also mechanically coupled to lubricating oil circulating pump 200. Alternatively, motor 401 may drive compressor 14, with lubricating oil circulating pump 200 being coupled to the crankshaft of compressor 14. Condensed liquid pump 100 is mechanically coupled to motor 405, which may be a fixed speed electric motor, a variable speed electric motor, or other drive member. Motor 405 is preferably electrically coupled to, and controlled by, microcontroller circuit 56. Motor 401 and compressor 14 may together comprise a hermetic motor-compressor unit 15, as is known in the art, which may include pump 200 or other lubrication means.

FIG. 6 illustrates an embodiment of the invention in which compressor 14, lubricating oil circulating pump 200, and condensed liquid pump 100 are all mechanically coupled to, and driven by, compressor motor 401 or another single drive member. It should be understood that the embodiments of the invention illustrated by FIGS. 5 and 6 may also include suitable gear reduction members (not shown) as are known in the art, and whose application to drive the compressor 14 and pumps 100, 200 at different speeds would be obvious to one skilled in the art.

FIG. 7 illustrates an embodiment of the invention in which motor 401 drives compressor 14 but does not drive pumps 100, 200. Pumps 100 and/or 200 are mechanically coupled to, and driven by, motor 406. Motor 406 may be a fixed speed electric motor, a variable speed electric motor, or another type of drive member. This embodiment provides additional flexibility in controlling the speeds of pumps 100 and/or 200 independently of the speed of compressor 14, and thereby ensures adequate lubricating oil flow at all speeds of compressor 14. Pumps 100 and/or 200 may also each be individually driven by motors such as motor 406. This provides additional flexibility which is particularly important for variable speed compressors. As discussed in my U.S. Pat. No. 5,067,326, incorporated herein by reference in its entirety, the minimum speed of a variable speed compressor may be determined by safe oil pressure limits. Independent control of the speeds of motors 401 and 406 thus eliminates the need to increase compressor speed simply to raise oil pressure. All of the above motor drive arrangements are applicable to embodiments in which the condensed liquid pump is used to increase the pressure in liquid line 60, but where no compressor body cooling jacket is employed.

Figure 8:
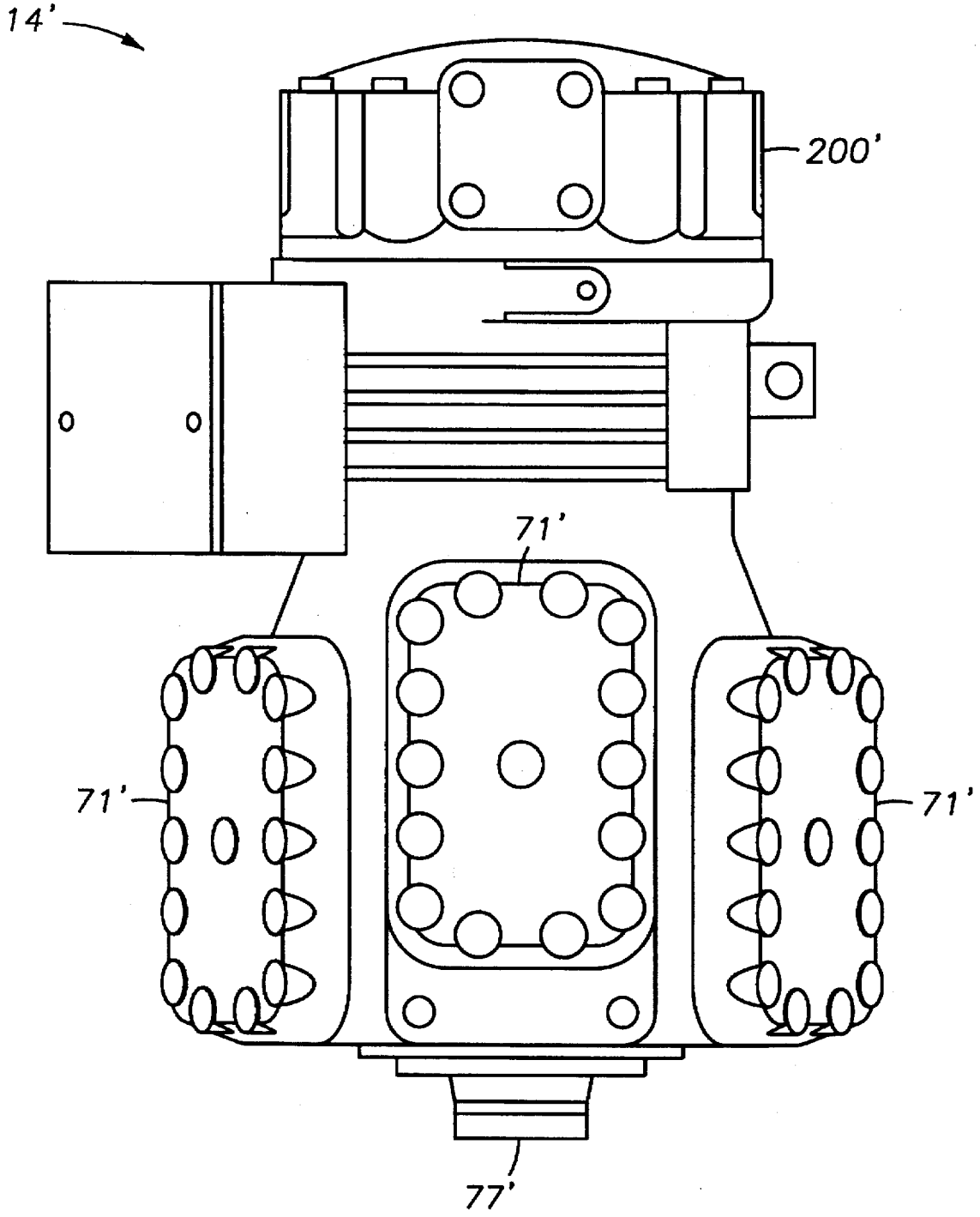
FIG. 8 illustrates a six-cylinder two-stage compressor typical in the art, in which the lubricating oil pump is driven by the crankshaft of the compressor.

FIG. 8 illustrates a six-cylinder two-stage compressor 14', typical in the art, in which oil pump 200' is driven by the crankshaft of compressor 14'. Such a compressor may be retrofit in accordance with an embodiment of the present invention such as that illustrated in FIG. 6, in which compressor 14, lubricating oil circulating pump 200, and condensed liquid pump 100 are all driven by compressor motor 401, with pumps 100 and 200 being coupled to the crankshaft of compressor 14. The retrofit of an existing compressor-oil pump combination such as 14' and 200' where the oil pump is driven by the compressor crankshaft, is accomplished by insertion of a condensed liquid pump (such as pump 100 in FIG. 6) between the compressor 14' and oil pump 200'. Internal connections may then be made from the pump to the cylinder head(s). This arrangement facilitates cooling of the lubricating oil by the proximity of the condensed liquid pump to the oil pump 200' and compressor crankcase. Cooling may be further enhanced by use of a heat exchanger as discussed above.

The retrofit of an existing compressor-oil pump combination such as 14' and 200' may also be accomplished by the addition of a separately driven condensed liquid pump (such as pump 100 in FIG. 5). In this case, condensed liquid pump 100 is external to the compressor-oil pump combination, and the condensed liquid pump may be driven by an electric motor as described above.

The signals provided by sensors such as oil pressure sensor 94 and/or oil level sensor 93 (FIG. 2) may be used by microcontroller circuit 56 to detect faults such as a failure of lubricating oil circulating pump 200, an oil leak, a blockage of oil lines 210 or 215, or the like. Microcontroller 56 may then sound an alarm or shut down compressor 14 to avoid compressor damage due to inadequate lubrication. It should be understood that in all the above embodiments, the motors may be electrically coupled to microcontroller 56, which then controls their speeds.

While the embodiment of the invention illustrated in FIG. 1 has been described with respect to a single compressor (14), any number of compressors may be used. In single compressor and multiple compressor embodiments utilizing an individual condensed liquid pump 100 for each compressor, additional diagnostic capabilities are realized. For example, because microcontroller circuit 56 may control the operation of each condensed liquid pump, the operating time and coolant flow rates may be monitored and compared for each of the compressors. Also, the coolant flow for any individual compressor may be cumulated and the variation in coolant flow rate over time may be analyzed. The coolant flow may be calculated by microcontroller circuit 56 or measured directly by a sensor such as coolant flowmeter 19. An increase in coolant flow for a compressor may indicate a problem such as an exhaust valve failure. Similarly, the flow rate may be compared to a previously measured flow rate and a substantial difference for a single compressor, or for one compressor in a multiple compressor system, may be indicative of a service problem for that compressor. This information can be used by microcontroller circuit 56 or a remote computer (not shown) to sound an alarm 59, call out via a modem (not shown) to notify service personnel of an impending problem, to shut down the compressor(s), or to take other corrective action. The present invention thus provides a substantial savings in the operation and maintenance costs of refrigeration compressors relative to the current state of the art, and is indicative of a development that will be welcomed by the refrigeration field.

While the invention has been described in accordance with reciprocating compressors and air cooled condensers, one experienced in the art may easily apply the invention to compressors of all types, including multiple-stage and multiple-compressor systems, and water or fluid cooled condensers of all sorts. It is intended that the current patent shall apply to all sorts of compressors and condensers. These embodiments have not been specifically described because they are considered redundant in application of the invention in view of the above description.

Further, the present invention is equally applicable to condenser systems employing modulation of multiple condenser cooling fans or water flow modulation in the case of water cooled condensers. As would be obvious to one skilled in the art, many other applications of the present invention are possible and the description provided herein is intended to be limited only by the claims appended hereto.

I claim:

1. A refrigeration system, comprising:

a compressor for compressing a gaseous refrigerant, said compressor having a body with a cooling jacket for receiving a liquid refrigerant for cooling the body, an exhaust manifold for receiving the compressed gaseous refrigerant after the gaseous refrigerant is compressed, said cooling jacket having an outlet directly coupled to the exhaust manifold for transporting the liquid refrigerant from the cooling passage to the exhaust manifold;

a condenser for receiving and condensing the compressed gaseous refrigerant into a liquid refrigerant; and a conduit member for transporting the liquid refrigerant from said condenser to said cooling passage.

2. The refrigeration system of claim 1, further comprising a condensed liquid pump disposed in the conduit member for pumping the liquid refrigerant from the condenser to the cooling jacket.

3. The refrigeration system of claim 2 further comprising a cylinder head sealingly disposed on the compressor, said cylinder head having an exhaust manifold.

4. The refrigeration system of claim 3 further comprising a temperature sensor producing a signal representative of the temperature of the liquid refrigerant within the cooling passage.

5. The refrigeration system of claim 4 further comprising a control member electrically connected to said temperature sensor and said condensed liquid pump for controlling the flow of the liquid refrigerant through said conduit member as a function of the signal produced by said temperature sensor.

6. The refrigeration system of claim 5 wherein said control member includes a microprocessor.

7. The refrigeration system of claim 6 wherein said conduit member receives the liquid refrigerant from said condenser.

8. The refrigeration system of claim 7 further comprising a lubrication system for lubricating the compressor, said lubrication system comprising a lubricating oil pump for circulating a lubricating oil through the compressor.

9. The refrigeration system of claim 8 further comprising a lubricating oil line coupled to the lubricating oil pump for transporting lubricating oil from the lubricating oil pump to the compressor.

10. The refrigeration system of claim 9 wherein the conduit member is disposed in thermal contact with the lubrication system for cooling the lubricating oil.

11. The refrigeration system of claim 9 wherein the conduit member is disposed in thermal contact with the lubricating oil line for cooling the lubricating oil.

12. The refrigeration system of claim 9 further comprising a heat exchanger coupled to the conduit member and the lubricating oil line for cooling the lubricating oil.

13. The refrigeration system of claim 8 further comprising a first drive motor for operating the condensed liquid pump.

14. The refrigeration system of claim 13 further comprising a second drive motor for operating the lubricating oil pump.

15. The refrigeration system of claim 13 wherein the first drive motor also operates the lubricating oil pump.

16. A method of cooling a compressor body for a refrigeration system comprising the steps of:

compressing a low pressure refrigerant to a high pressure refrigerant in the compressor body;

discharging the high pressure refrigerant to an exhaust manifold within a compressor head;

injecting a liquid refrigerant coolant into a cooling passage surrounding the compressor body;

discharging the liquid refrigerant coolant from the cooling passage into the exhaust manifold within the compressor head;

mixing the high pressure refrigerant with the liquid refrigerant coolant within the exhaust manifold.

17. The method of claim 16 further comprising the step of controlling the flow rate of the liquid refrigerant coolant into the cooling passage of the compressor body to maintain the temperature of the compressor body at a predetermined value.

18. The method of claim 17 further comprising the steps of:

measuring the temperature of the liquid refrigerant coolant within the cooling passage in the compressor body;

sending signals representative of said temperature to a control member; and controlling the flow of the liquid refrigerant coolant into the cooling passage to maintain the temperature of the liquid refrigerant coolant substantially constant by means of the control member.

19. A compressor body cooling system comprising:

a compressor for compressing a relatively low pressure gaseous refrigerant to a relatively high pressure gaseous refrigerant;

a condenser in closed loop connection with the compressor for condensing the high pressure gaseous refrigerant to a liquid refrigerant;

a compressor body cooling jacket disposed in thermal contact with a compressor cylinder wall and having an inlet and an outlet, said compressor cylinder wall disposed within the compressor body;

a conduit member disposed between the condenser and the cooling jacket inlet; and a condensed liquid pump disposed in the conduit member for pumping liquid refrigerant coolant from the condenser to the cooling jacket inlet.

20. The compressor body cooling system of claim 19, further comprising a compressor exhaust manifold coupled to the cooling jacket outlet.

21. The compressor body cooling system of claim 20 further comprising a variable speed electric motor for operating the condensed liquid pump.

22. The compressor body cooling system of claim 21, further comprising a compressor cylinder head sealingly disposed on the compressor and wherein the compressor exhaust manifold is disposed within the compressor cylinder head and receives the relatively high pressure gaseous refrigerant.

23. The compressor body cooling system of claim 22 wherein the compressor exhaust manifold also receives the liquid refrigerant coolant from the cooling jacket outlet.

24. The compressor body cooling system of claim 23 wherein the relatively high pressure gaseous refrigerant and the liquid refrigerant coolant from the cooling jacket outlet are mixed in the compressor exhaust manifold.

25. A refrigeration compressor for compressing a gaseous refrigerant, comprising:

a compressor body comprising a cylinder, a crankcase, and a piston, said piston reciprocatingly disposed within the cylinder;

an exhaust manifold for receiving a compressed gaseous refrigerant;

a cooling jacket disposed in thermal contact with the cylinder, for receiving heat from the cylinder, said cooling jacket comprising:

a cooling jacket inlet coupled to the cooling jacket for receiving a coolant;

a cooling jacket outlet coupled to the cooling jacket and coupled directly to the exhaust manifold.

26. The refrigeration compressor of claim 25, wherein the exhaust manifold is disposed within a cylinder head of the compressor.

27. The refrigeration compressor of claim 26, further comprising a coolant supply for continuously supplying coolant to the cooling jacket inlet, through the cooling jacket, and discharging the coolant into the exhaust manifold.

28. The refrigeration compressor of claim 27 further comprising a temperature sensor for providing a signal representative of the temperature of the coolant within the cooling jacket.

29. The refrigeration compressor of claim 27 further comprising an oil pump for circulating a lubricating oil within the compressor.

30. The refrigeration compressor of claim 29 wherein the lubricating oil is cooled by the coolant.

31. A method of monitoring the discharge of coolant to a refrigeration compressor and determining compressor operating condition comprising the steps of:

measuring a first flow rate of coolant to a compressor body cooling jacket at a first time;

measuring a second flow rate of coolant to a compressor body cooling jacket at a second time;

comparing the first and second flow rates of coolant and calculating a flow rate difference;

comparing the flow rate difference to a predetermined value;

triggering an alarm if the flow rate difference exceeds the predetermined value.

32. The method of claim 31, further comprising:

monitoring a first temperature of the coolant in the compressor cooling jacket at the first time;

monitoring a second temperature of the coolant in the compressor cooling jacket at the second time;

comparing the first and second temperatures of the coolant and calculating a temperature difference.

33. A refrigeration system, comprising:

a compressor for compressing a gaseous refrigerant, said compressor having a body with a cooling passage for receiving a liquid refrigerant for cooling the body, an exhaust manifold for receiving the compressed gaseous refrigerant after the gaseous refrigerant is compressed, said cooling passage having an outlet coupled to the exhaust manifold for transporting the liquid refrigerant from the cooling passage to the exhaust manifold;

a condenser for receiving and condensing the compressed gaseous refrigerant into a liquid refrigerant;

a conduit member for transporting the liquid refrigerant from said condenser to said cooling passage; and a condensed liquid pump disposed in the conduit member for pumping the liquid refrigerant from the condenser to the cooling passage.

34. A refrigeration compressor for compressing a gaseous refrigerant, comprising:

a compressor body comprising a cylinder, a crankcase, and a piston, said piston reciprocatingly disposed within the cylinder;

an exhaust manifold for receiving a compressed gaseous refrigerant disposed within a cylinder head of the compressor;

a cooling jacket disposed in thermal contact with the cylinder, for receiving heat from the cylinder, said cooling jacket comprising:

a cooling jacket inlet coupled to the cooling jacket for receiving a coolant;

a cooling jacket outlet coupled to the cooling jacket and coupled to the exhaust manifold;

a coolant supply for continuously supplying coolant to the cooling jacket inlet, through the cooling jacket, and discharging the coolant into the exhaust manifold; and a temperature sensor for providing a signal representative of the temperature of the coolant within the cooling jacket.

35. A refrigeration system, comprising:

an expansion device for expanding a liquid refrigerant to a gaseous refrigerant;

a compressor for compressing the gaseous refrigerant;

a condenser for receiving and condensing the compressed gaseous refrigerant into the liquid refrigerant; and a conduit member transporting the liquid refrigerant from the condenser to the expansion device;

a condensed liquid pump for increasing the pressure of the liquid refrigerant in the conduit member; and a lubrication system for lubricating the compressor, said lubrication system comprising a lubricating oil pump for circulating a lubricating oil through the compressor, wherein the conduit member is disposed in thermal contact with the lubrication system for cooling the lubricating oil.

* * * * *